US006628798B2

(12) United States Patent
Teshima et al.

(10) Patent No.: US 6,628,798 B2
(45) Date of Patent: Sep. 30, 2003

(54) VIBRATION ACTUATOR HAVING THREE VIBRATION MODES

(75) Inventors: Makoto Teshima, Sendai (JP); Koji Uchida, Sendai (JP); Yutaka Suzuki, Sendai (JP); Toru Kumagai, Shiroishi (JP)

(73) Assignee: NEC Tokin Corporation, Sendai (JP)

( * ) Notice: Subject to any disclaimer, the term of this patent is extended or adjusted under 35 U.S.C. 154(b) by 0 days.

(21) Appl. No.: 09/547,309

(22) Filed: Apr. 11, 2000

(65) Prior Publication Data

US 2003/0112993 A1 Jun. 19, 2003

(30) Foreign Application Priority Data

Apr. 13, 1999 (JP) ..... 11-105974
Aug. 31, 1999 (JP) ..... 11-244351
Apr. 6, 2000 (JP) ..... 2000-104606

(51) Int. Cl.[7] ..... H04R 25/00
(52) U.S. Cl. ..... 381/396; 381/431
(58) Field of Search ..... 381/151, 152, 381/396, 398, 431, FOR 152, FOR 153; 340/311.1, 384.1, 388.1; 455/67.7, 226.4

(56) References Cited

U.S. PATENT DOCUMENTS 5,528,697 A * 6/1996 Saito ..... 381/396
5,861,686 A * 1/1999 Lee ..... 381/396
5,894,263 A * 4/1999 Shimakawa et al. ..... 381/396
6,208,237 B1 * 3/2001 Saiki et al. ..... 381/396
6,211,775 B1 * 4/2001 Lee et al. ..... 381/396
6,265,965 B1 * 7/2001 Lee ..... 381/396

FOREIGN PATENT DOCUMENTS

EP 0 791 405 A2 8/1997
EP 0 906 790 A1 4/1999
JP 9-70571 3/1997

* cited by examiner

*Primary Examiner*—Curtis Kuntz
*Assistant Examiner*—Suhan Ni
(74) *Attorney, Agent, or Firm*—Frishauf, Holtz, Goodman & Chick, P.C.

(57) ABSTRACT

In a vibration actuator using a magnetic circuit device (14), a supporting arrangement (23) elastically supports the magnetic circuit device. A coil (17) is inserted into a magnetic gap (15) of the magnetic circuit device and is supported by a vibration plate (19). The vibration actuator has a first operation mode in which the magnetic circuit device mainly vibrates to transmit vibration through the vibration plate to the outside, a second vibration mode in which the coil mainly vibrates to produce a buzzer sound through the vibration plate, and a third vibration mode in which the magnetic circuit device and the coil mainly vibrate to produce a sound corresponding to a speech through the vibration plate.

29 Claims, 12 Drawing Sheets

VIBRATION ACTUATOR HAVING THREE VIBRATION MODES

BACKGROUND OF THE INVENTION

The present invention relates to a vibration actuator having an electromagnetic vibrator element, a method of driving the vibration actuator, a vibration apparatus with the vibration actuator mounted thereon, and a mobile apparatus including the vibration apparatus.

In recent years, a mobile telephone apparatus as a mobile apparatus has become more and more increasingly used. Typically, the mobile telephone apparatus is equipped with an actuator for generating body-felt vibration, another actuator for generating a buzzer sound, and a loudspeaker for generating a reproduced sound or a sound corresponding to speech. Thus, the mobile telephone apparatus is operable in three vibration modes by the use of two actuators and one or more loudspeakers mounted therein.

Generally, the mobile telephone apparatus is strongly requested to be reduced in size. Therefore, attempts have been made to reduce the number of devices mounted in the mobile telephone apparatus. For example, Japanese Unexamined Patent Publication (JP-A) No. H09-70571 discloses a pager as the mobile apparatus comprising an actuator including an electromagnetic vibrator element held by two plate-like or flat elastic members having different spring constants. In the actuator, the frequency of an electric current supplied to the electromagnetic vibrator element is selected to selectively resonate, as a resonated member, one of the two flat elastic members so that vibration is generated in a resonance frequency of the resonated member. Thus, the single actuator provides both the body-felt vibration and the buzzer sound. It is therefore possible to reduce the number of devices or components mounted in the pager.

However, the above-mentioned single actuator generates no more than the body-felt vibration and the buzzer sound. No consideration is made of generation of the sound corresponding to the speech.

SUMMARY OF THE INVENTION

It is therefore an object of the present invention to provide a vibration actuator having three vibration modes.

It is another object of the present invention to provide a method of driving the above-mentioned vibration actuator.

It is still another object of the present invention to provide a vibration apparatus equipped with the above-mentioned vibration actuator.

Other objects of the present invention will become clear as the description proceeds.

According to the present invention, there is provided a vibration actuator comprising a magnetic circuit device having a magnetic gap, a supporting device for elastically supporting the magnetic circuit device, a coil inserted into the magnetic gap, and a vibration plate supporting the coil, the actuator having a first vibration mode in which the magnetic circuit device mainly vibrates to transmit vibration through the vibration plate to the outside, a second vibration mode in which the coil mainly vibrates to produce a buzzer sound through the vibration plate, and a third vibration mode in which the magnetic circuit device and the coil mainly vibrate to produce a sound corresponding to a speech through the vibration plate.

According to the present invention, there is provided a method of driving the vibration actuator, the method comprising the steps of preparing a plurality of electric signals having different frequencies and supplying one of the electric signals to the coil to select one of the first, the second, and the third vibration modes.

According to the present invention, there is provided a method of driving the vibration actuator, the method comprising the steps of preparing a plurality of electric signals having different frequencies and supplying a superposition of at least two of the electric signals to the coil to simultaneously select at least two of the first, the second, and the third vibration modes.

According to the present invention, there is provided a vibration apparatus comprising the vibration actuator and a housing containing the vibration actuator.

According to the present invention, there is provided a mobile apparatus including the vibration apparatus.

DESCRIPTION OF THE PREFERRED EMBODIMENTS

Figure 1:
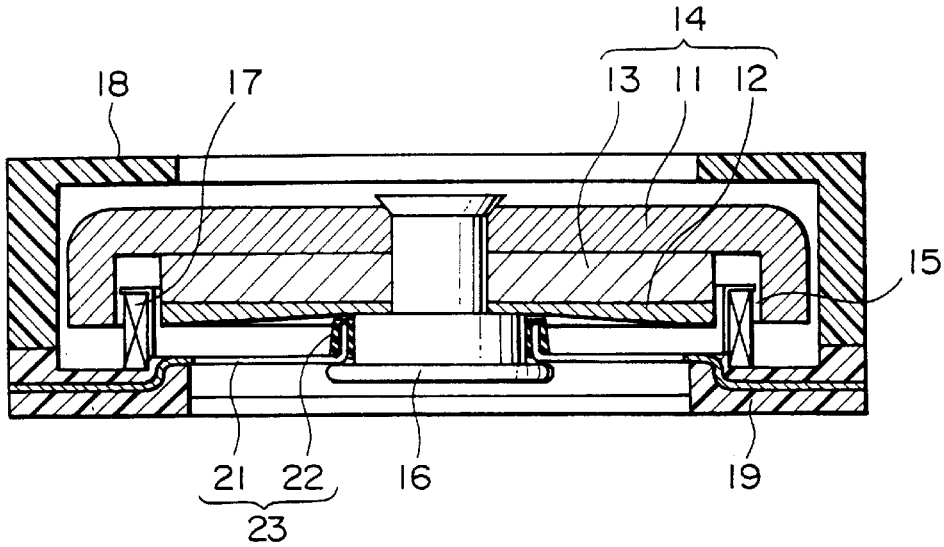
FIG. 1 is a sectional view of a vibration actuator according to a first embodiment of the present invention.

Now, description will be made of the present invention with reference to the drawing in conjunction with several preferred embodiments.

At first referring to FIG. 1, a vibration actuator according to a first embodiment of the present invention comprises a magnetic circuit device 14 composed of a yoke 11, a plate 12, and a permanent magnet 13. The yoke 11 extends over the plate 12 so as to form a magnetic gap 15 around the plate 12. The yoke 11, the plate 12, and the permanent magnet 13 are coupled to one another by a stud 16 inserted through center holes of the yoke 11, the plate 12, and the permanent magnet 13.

The vibration actuator further comprises a coil 17 inserted into the magnetic gap 15, a protector 18 surrounding the magnetic circuit device 14, and a vibration plate 19 made of resin. The coil 17 is wound around a bobbin integrally formed with the vibration plate 19. The protector 18 is made of a material same as the vibration plate 19 and fixed to the vibration plate 19 by welding. The protector 18 serves to restrict the movement of the magnetic circuit device 14 within a predetermined range. A combination of the magnetic circuit device 14 and the coil 17 forms an electromagnetic vibrator element.

To the vibration plate 19, an outer peripheral part of a metal damper or leaf spring 21 is fixed by insert molding. The leaf spring 21 has an inner part fixed to the stud 16 through an elastic material such as rubber. Thus, the magnetic circuit device 14 is flexibly or elastically supported by the vibration plate 19 through the leaf spring 21 and the elastic material 22. A combination of the leaf spring 21 and the elastic material 22 forms a supporting arrangement 23.

Figure 2:
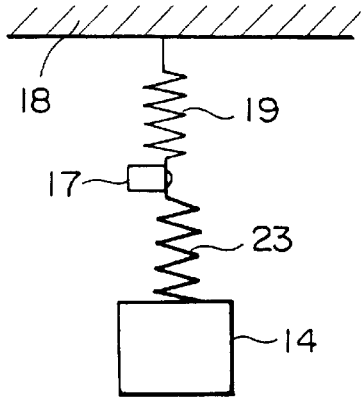
FIG. 2 is a view showing an equivalent model of the vibration actuator illustrated in FIG. 1.

Referring to FIG. 2 in addition, the above-mentioned vibration actuator is represented by an equivalent model. In the equivalent model in FIG. 2, similar parts are designated by like reference numerals as those used in FIG. 1.

The coil 17 is elastically supported by the protector 18 through the vibration plate 19. On the other hand, the magnetic circuit device 14 is elastically supported by the protector 18 through the supporting arrangement 23 and the vibration plate 19 connected in series. Since the magnetic circuit device 14 and the coil 17 form the electromagnetic vibrator element in combination, vibration is produced when the coil 17 is supplied with an electric signal having a sine wave or a rectangular wave. The frequency of vibration can be set to a desired value by selecting the frequency of the electric signal.

Therefore, the vibration actuator is suitable for use in a mobile telephone apparatus. The detail of a mounting structure of the vibration actuator in the mobile telephone apparatus will later be described.

Next, description will be made of a result of simulation using a simulation model in conjunction with various operating conditions in case where the vibration actuator in FIG. 1 is mounted in the mobile telephone apparatus.

At first, simulation was carried out for the operating condition in which the coil 17 was supplied with a sine-wave electric signal having a frequency of 140 Hz close to a resonance frequency determined by a total weight of the supporting arrangement 23 and the magnetic circuit device 14. In this case, the magnetic circuit device 14 mainly vibrated so that relative vibration was generated between the magnetic circuit device 14 and the vibration plate 19 and was transmitted as body-felt vibration to a housing of a telephone apparatus. The magnitude of the vibration was as follows. For example, in case where the electric signal having a frequency of 140 Hz and a voltage of 1.5 Vp-p was used, the vibration having an acceleration of 1G or more was obtained in the mobile telephone apparatus having a weight of 100 g.

Next, simulation was carried out for the operating condition in which the coil 17 was supplied with a rectangular-wave electric signal having a frequency (for example, 3 kHz) equal to a resonance frequency of the vibration plate 19 and a voltage of 5 Vp-p. In this case, it was confirmed that the coil 17 and the vibration plate 19 generated vibration to produce a buzzer sound transmitted to the outside. It was also confirmed that the magnetic circuit device 14 generated no substantial vibration.

Figure 3:
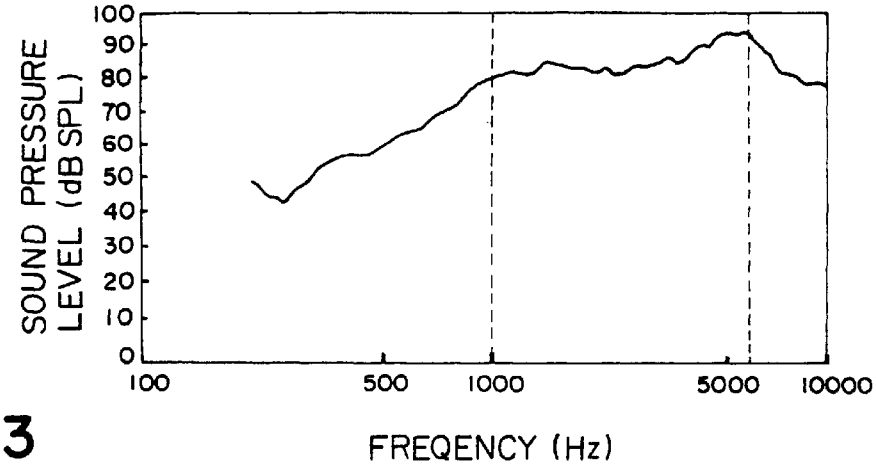
FIG. 3 is a graph showing a frequency characteristic in simulation of an operation mode in which a buzzer sound is produced.

The frequency characteristic in this operating condition is illustrated in FIG. 3 as actual experimental data. As seen from the figure, the sound pressure level has a value between 80 and 95 dBspl in a frequency range between 1 kHz and 6 kHz. Thus, the characteristic is not only sufficient for use as a buzzer but also usable as a melody ringer, a voice ringer, and a hands-free telephone as a landau speaker.

Next, simulation was carried out for the operating condition in which the coil 17 was supplied with an electric signal having a frequency of 1 kHz and a power of 10 mW. In this case, it was confirmed that the magnetic circuit device 14, the coil 17, and the vibration plate 19 vibrated to produce a sound corresponding to a speech through the vibration plate 19.

Figure 4:
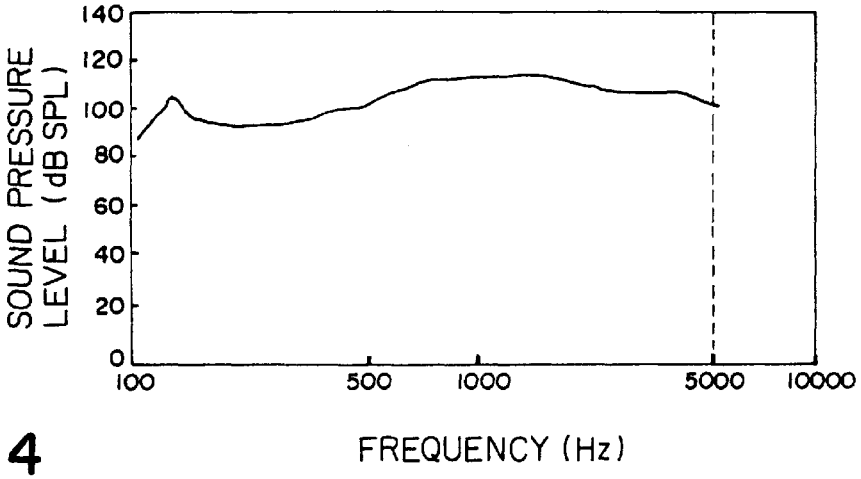
FIG. 4 is a graph showing a frequency characteristic obtained as measurement values by IEC711 measurement in simulation of another operation mode in which a sound corresponding to a speech is produced.
Figure 5:
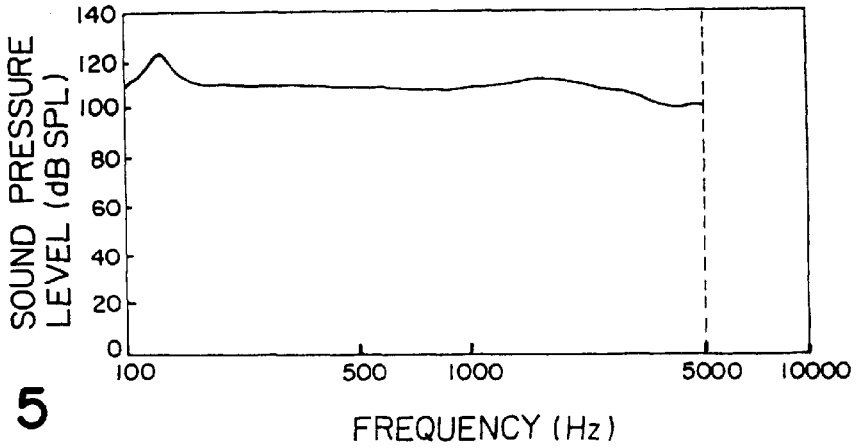
FIG. 5 is a graph similar to FIG. 4 except that measurement values are given by IEC318 measurement.

The frequency characteristic in this operating condition is illustrated in FIG. 4 as actual measurement values by measurement according to IEC711. As seen from the figure, the sound pressure level has a value between 85 and 115 dBspl in a frequency range between 100 Hz and 5 kHz. The similar frequency characteristic is illustrated in FIG. 5 as actual measurement values by measurement according to IEC318. As seen from the figure, the sound pressure level has a value between 100 and 130 dBspl in a frequency range between 100 Hz and 5 kHz. In either event, the characteristic is sufficient for use as a receiver.

As will be understood from the simulation results, the vibration actuator in FIG. 1 has a first vibration mode, a second vibration mode, and a third vibration mode. Specifically, in the first vibration mode, the magnetic circuit device 14 mainly vibrates to transmit low-frequency vibration, i.e., body-felt vibration through the vibration plate 19 to the outside. In the second vibration mode, the coil 17 mainly vibrates to produce intermediate-frequency vibration, i.e., a buzzer sound through the vibration plate 19. In the third vibration mode, the magnetic circuit device 14 and the coil 17 mainly vibrate to produce high-frequency vibration, i.e., a sound corresponding to a speech through the vibration plate 19.

Hereinafter, one example of a method of driving the above-mentioned vibration actuator will be described.

Preparation is made of a plurality of electric signals having different frequencies. One of the electric signals is supplied to the coil 17 to select one of the first, the second, and the third vibration modes. As a result, one of the body-felt vibration, the buzzer sound, and the sound corresponding to the speech is obtained.

Another example of the method of driving the vibration actuator will be described.

Preparation is made of a plurality of electric signals having different frequencies. A superposition of at least two of the electric signals is supplied to the coil 17 to simultaneously select a plurality of ones of the first, the second, and the third vibration modes. As a result, a plurality of ones of the body-felt vibration, the buzzer sound, and the voice corresponding to the speech are simultaneously obtained.

Figure 6:
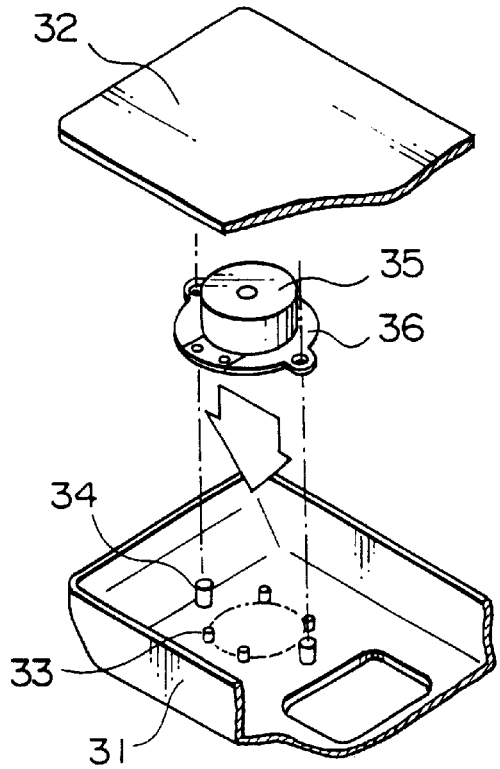
FIG. 6 is a perspective view of a characteristic part of a mounting structure of the vibration actuator in FIG. 1 in a mobile telephone apparatus.

Referring to FIG. 6, description will be made about a mounting structure of the vibration actuator in FIG. 1 in the mobile telephone apparatus. In this mounting structure, the vibration of the vibration plate 19 is directly utilized.

The mobile telephone apparatus includes a housing comprising a front case 31 and a back case 32 fitted and fixed thereto. Typically, the back case 32 also serves as a circuit board. The front case 31 is provided with stoppers 33 and riveting downs 34 formed on its inner surface. On the other hand, the vibration actuator 35 has a flange 36 integrally formed with a particular portion of the protector 18, the particular portion corresponding to the vibration plate 19 in a radial direction. When the flange 36 is engaged with the stoppers 33 and fastened to the riveting downs 34 by rivets (not shown), the vibration actuator 35 is properly positioned in the front case 31 and fixed thereto.

Figure 7:
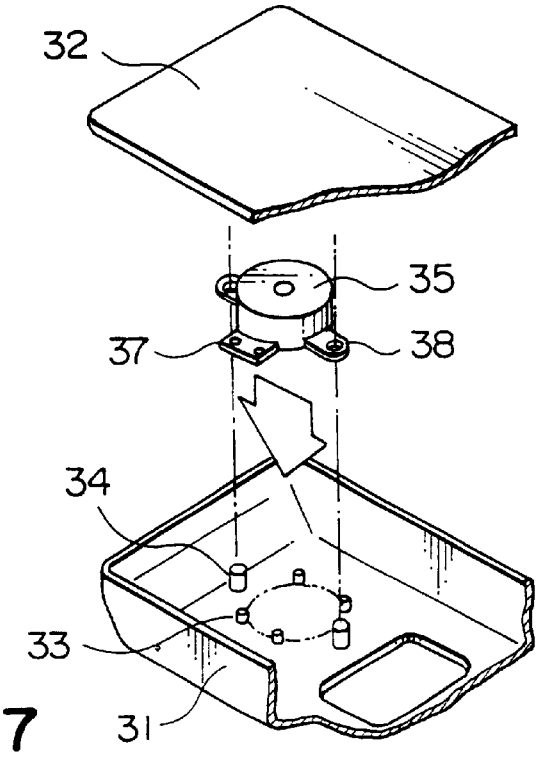
FIG. 7 is a perspective view of a characteristic part of another mounting structure of the vibration actuator in FIG. 1 in a mobile telephone apparatus.

Referring to FIG. 7, description will be made about another mounting structure of the vibration actuator in FIG. 1 in the mobile telephone apparatus. In this structure, the vibration of the vibration plate 19 is indirectly utilized through the housing. In other words, a part of the housing is used as a vibration plate.

In this case, the vibration actuator 35 has an engaging part 37 and a fitting part 38 integrally formed at an intermediate portion in an axial direction of the protector 18. When the engaging part 37 is engaged with the stoppers 33 and the fitting part 38 is fastened to the riveting downs 34 by rivets (not shown), the vibration actuator 35 is properly positioned in the front case 31 and fixed thereto. The vibration plate 19 is adhered to the inner surface of the front case 31 by a double-side adhesive tape.

Figure 8:
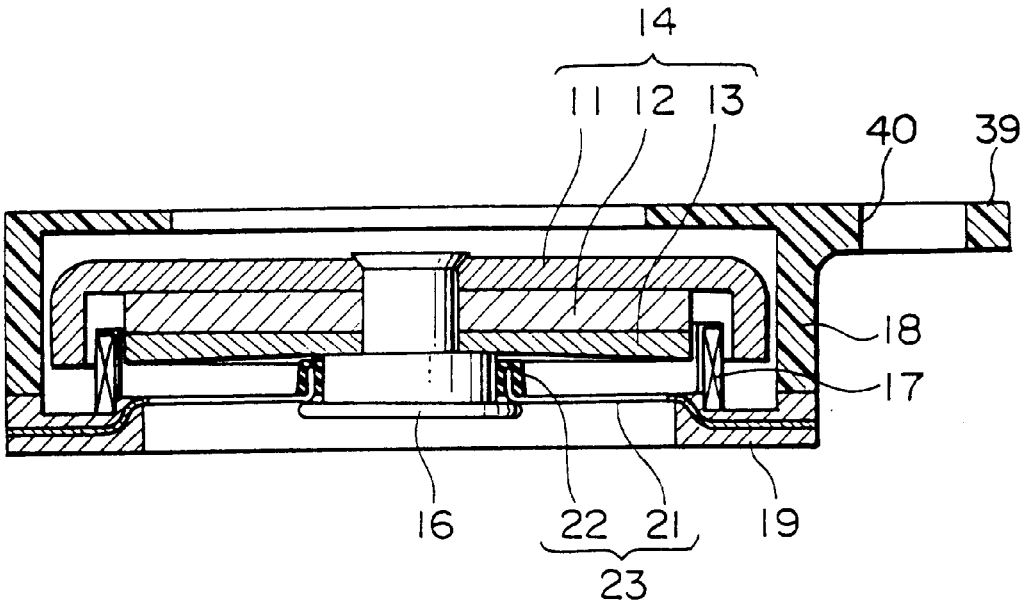
FIG. 8 is a sectional view of a vibration actuator according to a second embodiment of the present invention.

Referring to FIG. 8, a vibration actuator according to a second embodiment of the present invention will be described. Similar parts are designated by like reference numerals as those used in FIG. 1 and will not be described any longer.

The vibration actuator has a fitting protrusion 39 integrally formed on the protector 18. The fitting protrusion 39 is fixed to the inner surface of the front case 31 of the housing by the use of a fitting hole 40.

Upon carrying out telephone conversation, the side of the vibration plate 19 serves as a receiver and is therefore located near a user's ear. The leakage of magnetic flux is restricted by the Standard. Since the magnetic circuit device 14 has a structure in which the yoke 11 covers the permanent magnet 1, the leakage of magnetic flux at the side of the yoke 11 is small. Therefore, in case where the above-mentioned vibration actuator is mounted in the telephone apparatus, the leakage of magnetic flux to the outside is easily prevented. It will readily be understood that even the vibration actuator in FIG. 8 can produce practical characteristics in each of the first, the second, and the third modes, like in the vibration actuator in FIG. 1.

Figure 9:
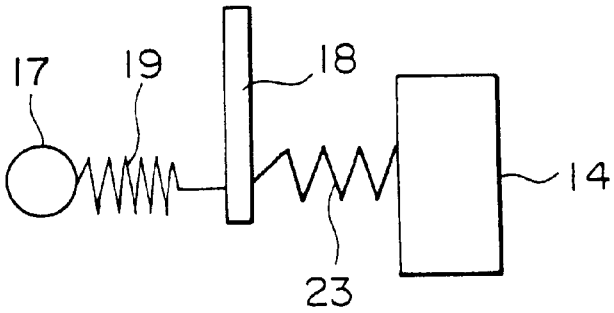
FIG. 9 is a view showing an equivalent model of a vibration actuator according to a third embodiment of the present invention.

Referring to FIG. 9, a vibration actuator according to a third embodiment of the present invention is represented by an equivalent model. In the vibration actuator corresponding to the equivalent model illustrated in the figure, the magnetic circuit device 14 is elastically supported by the protector 18 only through the supporting arrangement 23 while the coil 15 is elastically supported by the protector 18 only through the vibration plate 19. As will readily be understood, the similar operation can be achieved in this vibration actuator.

Figure 10:
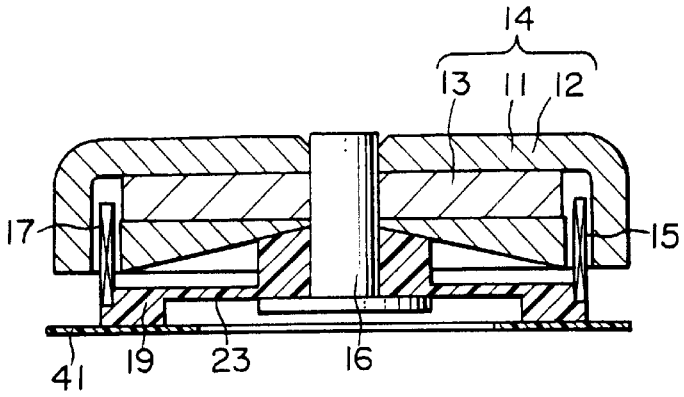
FIG. 10 is a sectional view of a vibration actuator according to a fourth embodiment of the present invention.
Figure 11:
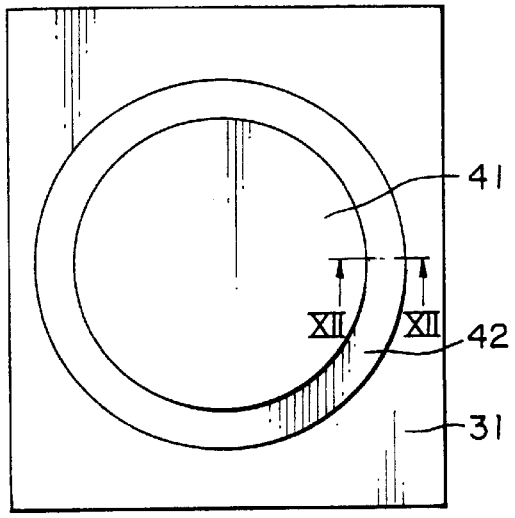
FIG. 11 is a plan view showing a mounting structure of the vibration actuator in FIG. 10 in a mobile telephone apparatus.
Figure 12:
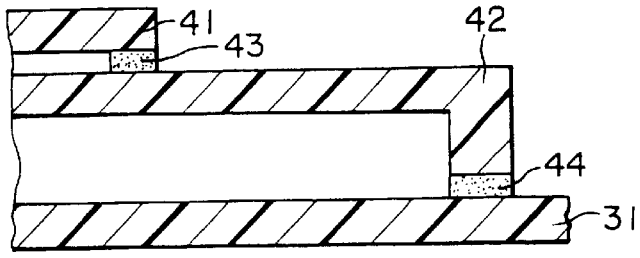
FIG. 12 is a partial sectional view taken along a line XII—XII in FIG. 11.

Referring to FIGS. 10 through 12, description will be made of a vibration actuator according to a fourth embodiment of the present invention and a mounting structure of the vibration actuator in a mobile telephone apparatus. Similar parts are designated by like reference numerals as those used in FIG. 1 and will not be described any longer.

In the vibration actuator according to the fourth embodiment, the vibration plate 19 and the supporting arrangement 23 are integrally formed by resin. A fitting member 41 is fixed to the vibration plate 19. Furthermore, the fitting member 41 is secured to a vibration transmitting member 42 by an adhesive 43. The vibration transmitting member 42 is secured to the front case 31 of the housing of the telephone apparatus by an adhesive 44. Thus, the vibration actuator is mounted in the mobile telephone apparatus.

At least one of the adhesives 43 and 44 may be replaced by a well-known double-side adhesive tape. In this event, the double-side adhesive tape serves as an elastic material and the vibration is appropriately transmitted from the vibration plate 19 through the vibration transmitting member 42 to the front case 31. As will readily be understood, the vibration actuator in FIG. 10 is capable of producing practical characteristics in the first, the second, and the third modes, like the vibration actuator in FIG. 1.

Figure 13:
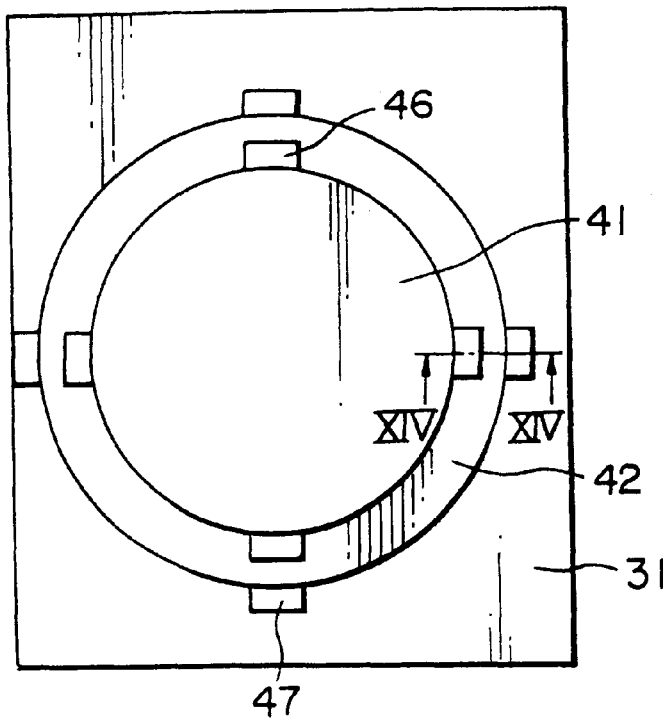
FIG. 13 is a plan view showing another mounting structure of the vibration actuator in FIG. 10 in the mobile telephone apparatus.
Figure 14:
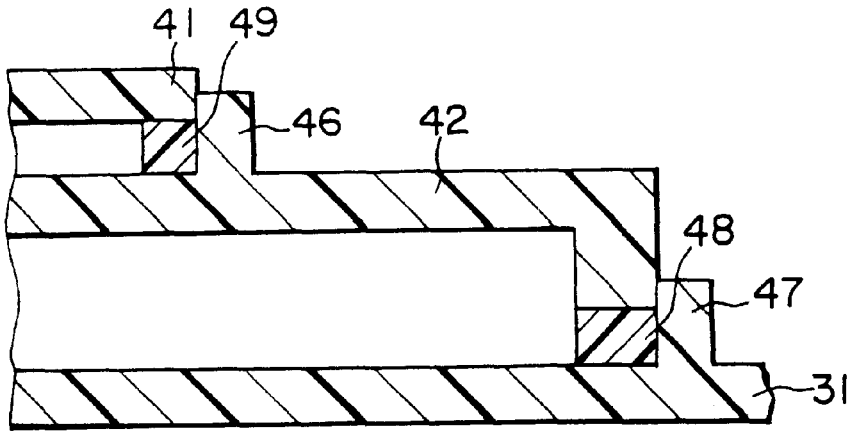
FIG. 14 is a partial sectional view taken along a line XIV-XIV in FIG. 13.

Referring to FIGS. 13 and 14, description will be made of another example of the structure of mounting the vibration actuator in FIG. 10 in the mobile telephone apparatus. Similar parts are designated by like reference numerals as those used in FIGS. 11 and 12 and will not be described any longer.

The vibration transmitting member 42 has four positioning protrusions 46 equiangularly spaced from one another around an area where the vibration actuator is to be mounted. On the other hand, the front case 31 of the housing of the telephone apparatus has four positioning protrusions 47 similarly arranged around an area where the vibration transmitting member 42 is to be mounted. The fitting member 41 is positioned by the positioning protrusions 46 with respect to the vibration transmitting member 42 and secured by a double-side adhesive tape 48 to the vibration transmitting member 42. The vibration transmitting member 42 is positioned by the positioning protrusions 47 with respect to the front case 31 of the housing and secured by a double-side adhesive tape 49 to the front case 31. Thus, the vibration actuator is mounted in the mobile telephone apparatus. Preferably, these component secured by the double-side adhesive tapes 48 and 49 are further fixed by one of thermal staking or caulking, press-fitting, and screwing in order to improve the mechanical strength.

With the above-mentioned structure, from the fitting member 41 to the vibration transmitting member 42 and further from the vibration transmitting member 42 to the front case 31, the vibration is transmitted through the elastic materials, i.e., the double-side adhesive tapes 48 and 49. Therefore, a sound pressure level produced by the mobile telephone apparatus is advantageously maintained at a high level.

Each of the double-side adhesive tapes 48 and 49 comprises a base member having both surfaces coated with a tackiness agent. As the base member, use is preferably made of any one of nonwoven fabric, a polyester film, foamed butyl rubber, and foamed polyethylene.

The positioning protrusions 46 and 48 may be replaced by positioning grooves. The double-side adhesive tapes 48 and 49 may be replaced by a foamed material.

Figure 15:
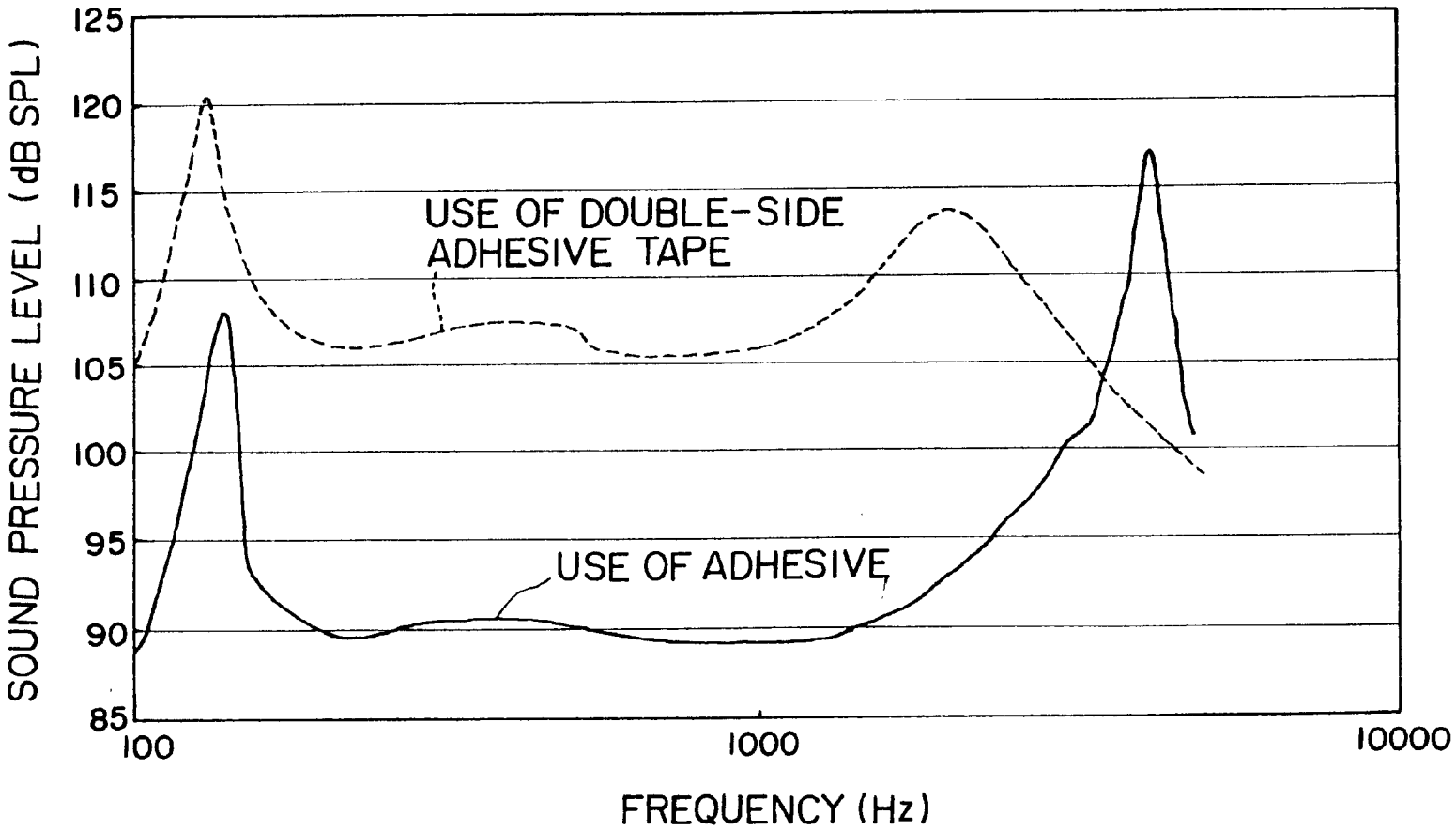
FIG. 15 is a graph for describing a frequency versus sound-pressure-level characteristic.

Referring to FIG. 15, description will be made of a frequency (Hz) versus sound-pressure-level (dB) characteristic.

In the figure, a solid-line curve represents the case where both of the junction between the fitting member 41 and the vibration transmitting member 42 and the junction between the vibration transmitting member 42 and the front case 31 are secured by the adhesives. A dashed-line curve represents the case where both of the junction between the fitting member 41 and the vibration transmitting member 42 and the junction between the vibration transmitting member 42 and the front case are secured by the double-side adhesive tapes. As seen from the figure, the sound pressure level is improved by about 15 dB by the use of the double-side adhesive tapes, as compared with the use of the adhesives.

Figure 16:
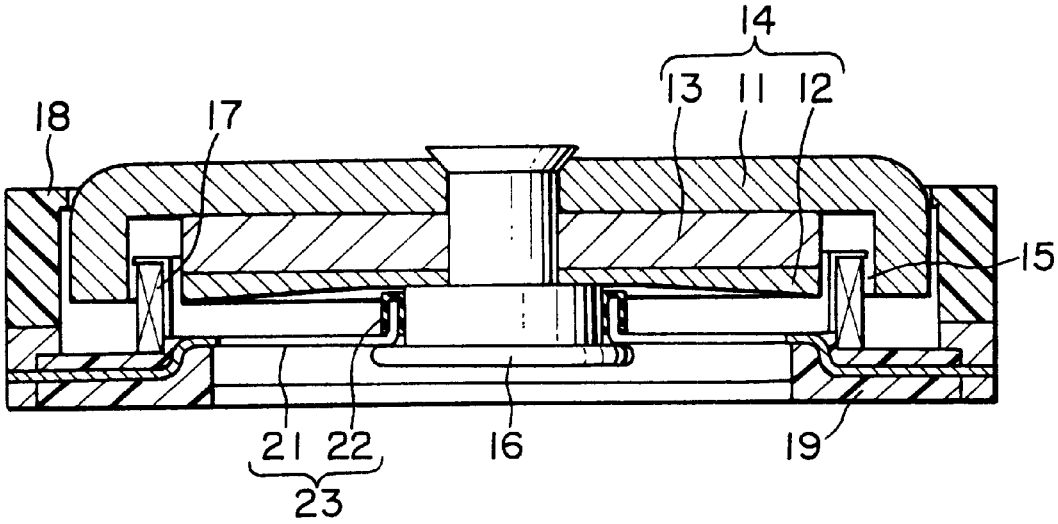
FIG. 16 is a sectional view of a vibration actuator according to a fifth embodiment of the present invention.

Referring to FIG. 16, description will be made of a vibration actuator according to a fifth embodiment of the present invention. Similar parts are designated by like reference numerals as those used in FIG. 1 and will not be described any longer.

In the vibration actuator according to the fifth embodiment, the protector 18 surrounds a side surface of the magnetic circuit device 14 while an upper surface thereof is exposed. Specifically, the yoke 13 protrudes upward above the protector 18 to be exposed without being covered with the protector 18. As will readily be understood, the vibration actuator in FIG. 16 is also capable of producing practical characteristics in the first, the second, and the third vibration mode, like the vibration actuator in FIG. 1.

Recently, the manner how to use the mobile telephone apparatus is an important problem. In a public space such as a train, a theater, and a restaurant, any unpleasant influence upon the people in the surroundings must be taken into consideration. As the manner during telephone conversation in the public space, the influence of not only a user's voice but also a sound leakage from a receiver must be considered.

Figure 17:
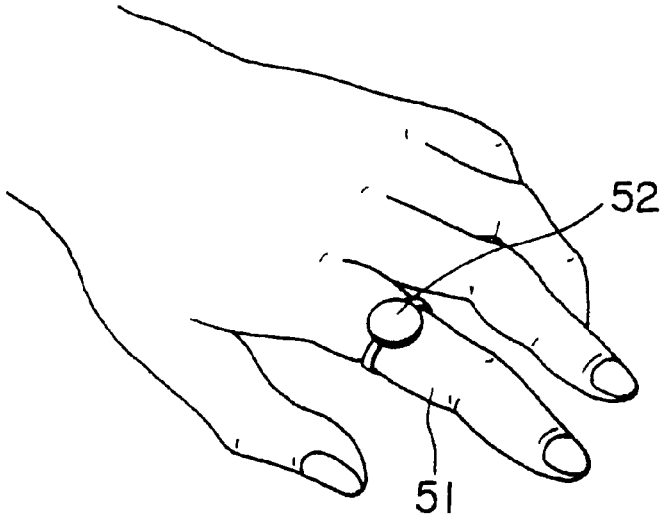
FIG. 17 is a view showing a ring-shaped vibration apparatus fitted to a human finger.
Figure 18:
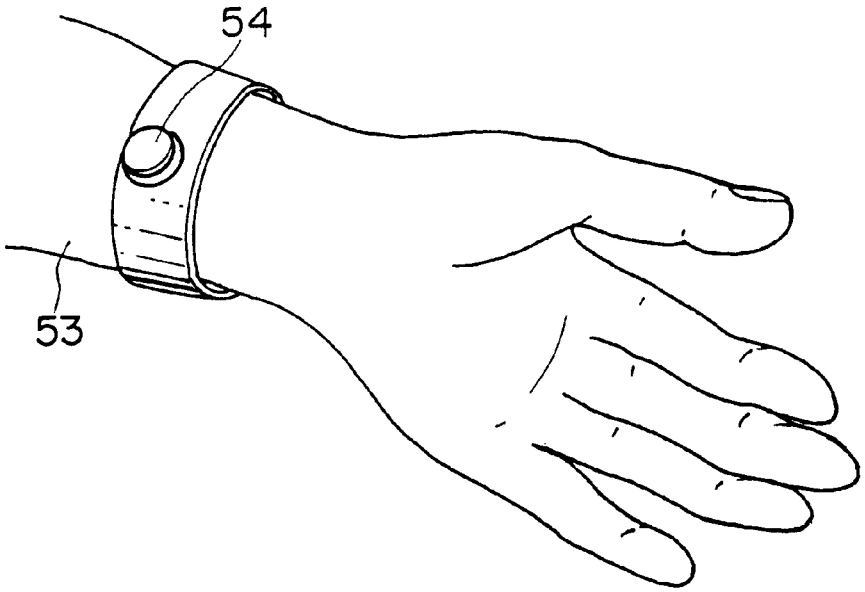
FIG. 18 is a view showing a bracelet-shaped vibration apparatus fitted to a human forearm.

In view of the above, the vibration actuator in FIG. 16 is mounted in a housing to form a vibration apparatus like a mobile telephone apparatus. Referring to FIG. 17, a ring-shaped vibrator 52 is adapted to be fitted to a human finger 51 as a ring. Referring to FIG. 18, a bracelet-shaped vibrator 54 is adapted to be fitted to a human forearm 53. The ring-shaped vibrator 52 or the bracelet-shaped vibrator 54 is designed to have an application mode in which the yoke 13 is vibrationally coupled to the human body, for example, in direct contact with the human body.

In the above-mentioned application mode, a bone, a tendon, a skin, or a subcutaneous tissue of the human body is vibrated to generate an audible sound or a sensible vibration. Therefore, it is possible to listen to a speech by putting a palm on the ear, inserting a fingertip into the ear, or putting a nail on the ear.

Figure 19:
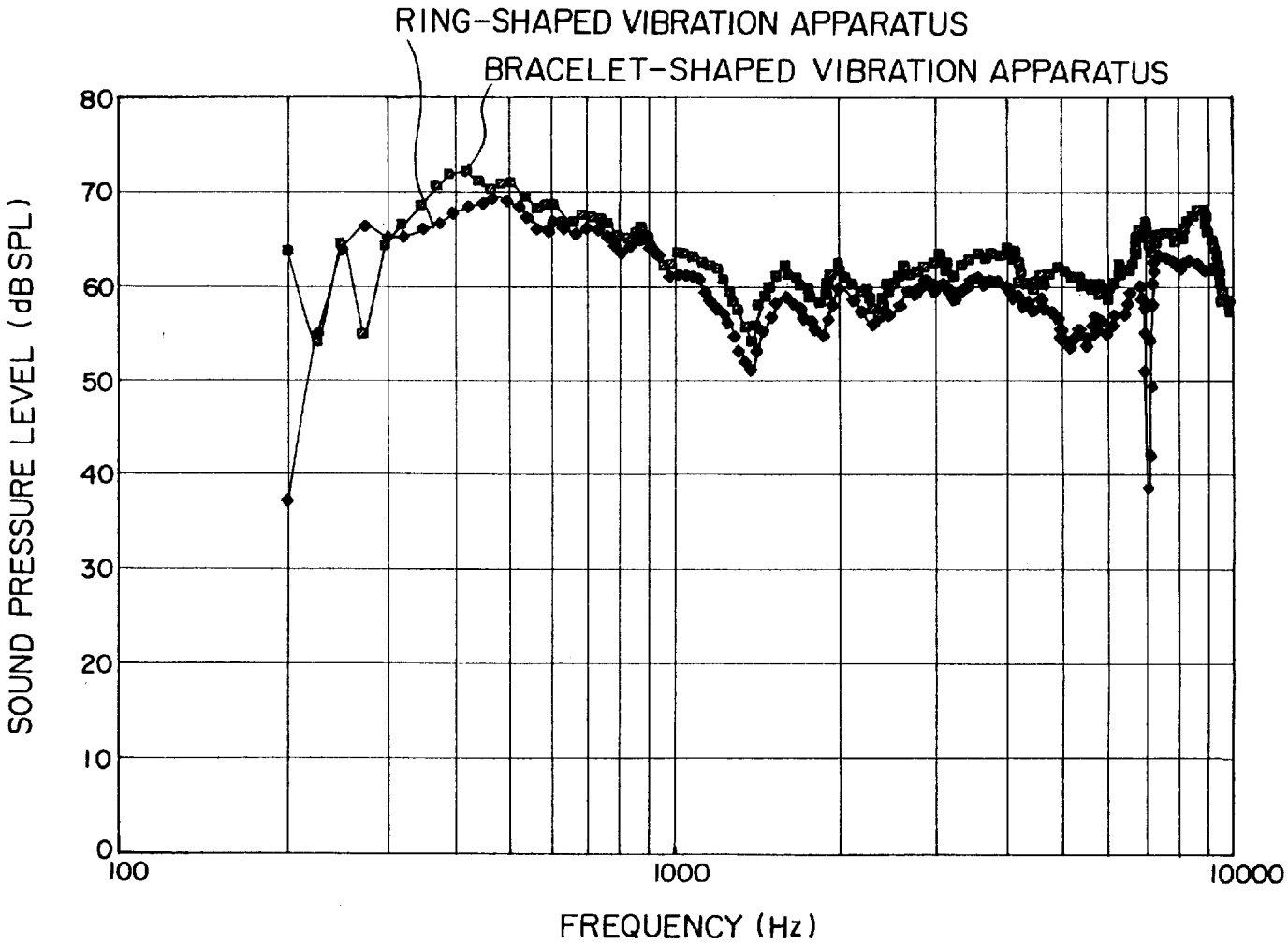
FIG. 19 is a view showing sound transmission characteristics of the ring-shaped vibration apparatus and the bracelet-shaped vibration apparatus illustrated in FIGS. 17 and 18.

By the use of the vibration actuator illustrated in FIG. 16, the ring-shaped vibrator 52 or the bracelet-shaped vibrator 54 having an outer diameter of 18 mm and a height of 6 mm was prepared. Herein, the yoke 11 protruding from the protector 18 had a height selected between 0.5 and 2 mm. The ring-shaped vibrator 52 or the bracelet-shaped vibrator 54 was fitted to the human body, and supplied with a power of 0.5 Wrms. A microphone was arranged at a distance of 10 cm to measure a sound pressure characteristic. As a result, the sound pressure characteristic was sufficient for use in a receiver or a loudspeaker of a telephone apparatus, as shown in FIG. 19.

Figure 20:
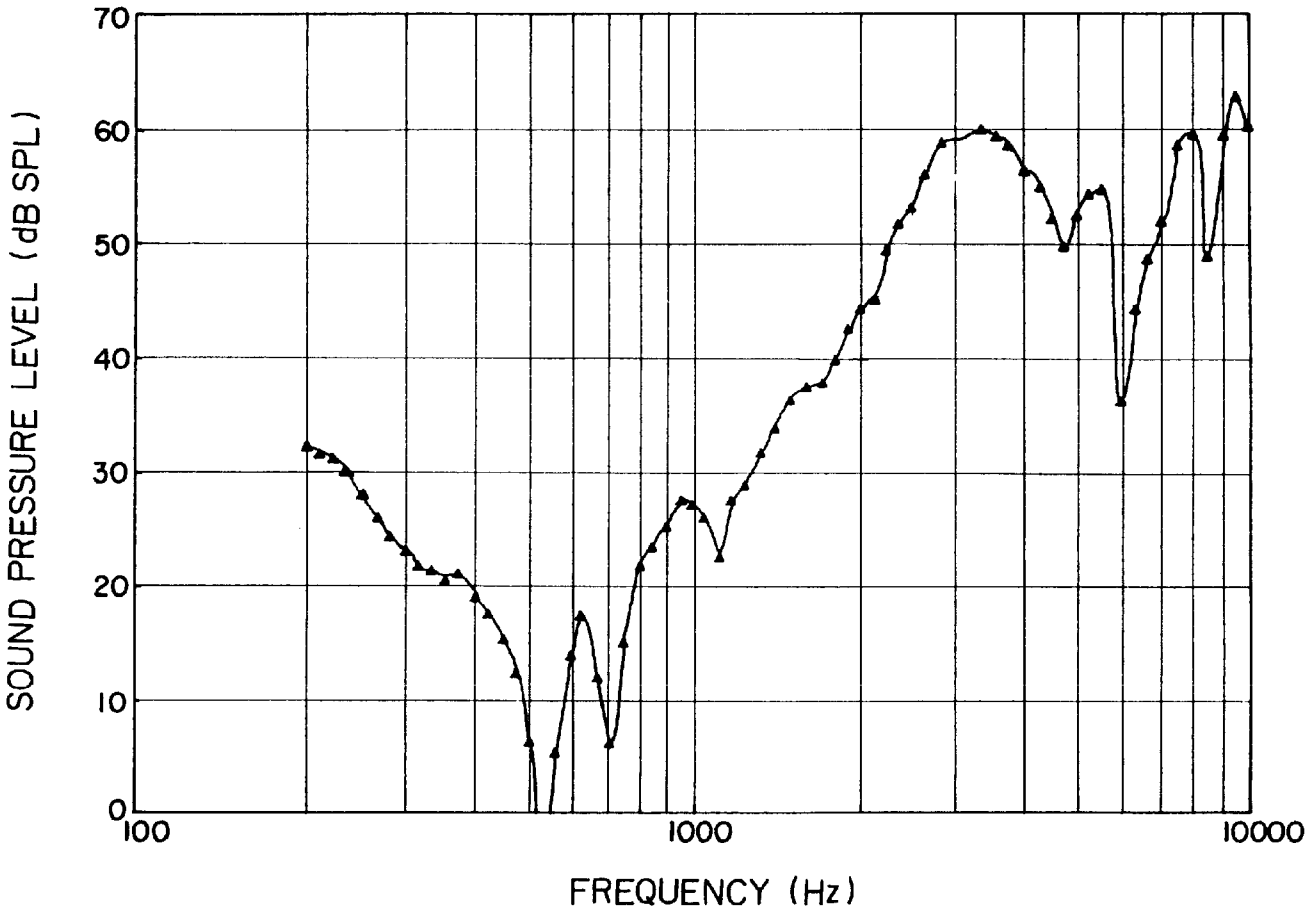
FIG. 20 is a view showing a sound leakage characteristic of the vibration apparatus.

Furthermore, by selecting a spring constant of the leaf spring 21, it is possible to efficiently improve a vibration transmitting characteristic to the bone or the tendon. Therefore, by designing the vibration actuator so that the user listens to the speech via his hand, the sound leakage to the surroundings can be suppressed to an acceptable level (in FIG. 20, not higher than 60 dBspl at a distance of 10 cm) at which the influence can be ignored. In the experimental studies by the present inventors, an appropriate spring constant has been confirmed. Specifically, in the vibration actuator having the size and the configuration mentioned above, the balance between the sound transmission and the sound leakage was most excellent when the leaf spring 21 had a spring constant of about $1.96\times10^{-3}$ N/m (200 g/mm). In addition, the spring constant within a range between $1.4\times10^{-3}$ N/m and $8\times10^{-3}$ N/m was acceptable for practical use. Since the ring-shaped vibration apparatus 52 or the bracelet-shaped vibration apparatus 54 directly vibrates the wrist or the finger, a sufficient touch or feel can be obtained even with silent vibration of a frequency between 100 and 300 Hz.

Figure 21:
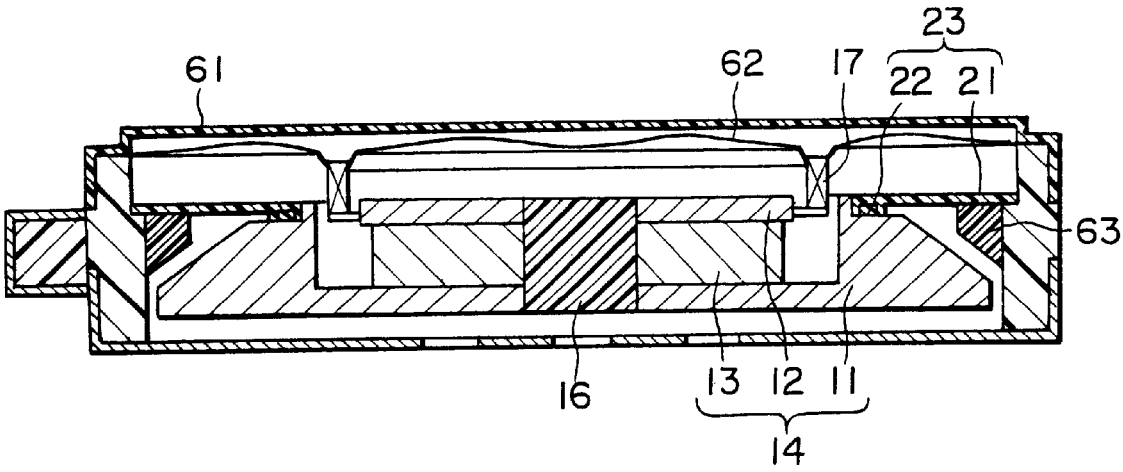
FIG. 21 is a sectional view of a vibration actuator according to a sixth embodiment of the present invention.

Referring to FIG. 21, description will be made of a vibration actuator according to a sixth embodiment of the present invention. Similar parts are designated by like reference numerals as those used in FIG. 1 and will not be described any longer.

The vibration actuator according to the sixth embodiment comprises an outer case 61, a vibration plate 62 fixed at its periphery to the outer case 61 and supporting the coil 17, and a stopper 63 fixed to the outer case 61 to prevent excessive vibration of the magnetic circuit device 14. The vibration plate 62 corresponds to the vibration plate 19 of the vibration actuator in FIG. 1 but comprises a plastic film in this embodiment. As will readily be understood, the vibration actuator in FIG. 21 is capable of producing practical characteristics in the first, the second, and the third modes, like the vibration actuator in FIG. 1.

In the foregoing, description has been mainly directed to the mobile telephone apparatus as the vibration apparatus. However, the present invention is also applicable to various other apparatuses such as a watch, a game apparatus, and a navigation apparatus.

As described above, according to the present invention, a single vibration actuator can perform the operations in the three modes, i.e., the body-felt vibration, the buzzer, and the speech. This contributes to the reduction in number of components and in size of the vibration apparatus such as the mobile telephone apparatus.

What is claimed is:

1. A vibration actuator comprising:

a magnetic circuit device having a magnetic gap, a supporting device which elastically supports said magnetic circuit device, a coil inserted into said magnetic gap, and a vibration plate supporting said coil, wherein said actuator has a first vibration mode in which said magnetic circuit device mainly vibrates to transmit body-felt vibration, a second vibration mode in which said coil mainly vibrates to produce a buzzer sound through said vibration plate, and a third vibration mode in which both said magnetic circuit device and said coil vibrate simultaneously so as to generate vibration of said vibration plate and produce a particular vibration wave represented by a combination of the vibrations of said magnetic circuit device and said vibration plate.

2. A vibration actuator as claimed in claim 1, wherein said supporting device is supported by said vibration plate.

3. A vibration actuator as claimed in claim 1, wherein said magnetic circuit device includes a yoke, a plate, and a permanent magnet interposed between said yoke and said plate, and wherein said yoke extends around said plate to form said magnetic gap at an outer periphery thereof.

4. A vibration actuator as claimed in claim 3, further comprising a stud by which said yoke, said plate, and said permanent magnet are coupled to one another.

5. A vibration actuator as claimed in claim 1, wherein said supporting device comprises a leaf spring having a first end fixed to said vibration plate, and an elastic material interposed between a second end of said leaf spring and said magnetic circuit device.

6. A vibration actuator as claimed in claim 1, further comprising a protector surrounding an outer periphery of said magnetic circuit device and connected to said vibration plate.

7. A vibration actuator as claimed in claim 1, further comprising a fitting member fixed to said vibration plate.

8. A vibration actuator as claimed in claim 1, wherein said vibration plate comprises a plastic film.

9. A vibration apparatus comprising a vibration actuator as claimed in claim 1 and a housing containing said vibration actuator.

10. A vibration apparatus as claimed in claim 9, wherein said housing is vibrationally coupled with said vibration plate of said vibration actuator.

11. A vibration apparatus comprising a vibration actuator as claimed in claim 6 and a housing containing said vibration actuator, wherein said housing is coupled to said protector and includes a vibration output terminal.

12. A vibration apparatus comprising a vibration actuator as claimed in claim 7, a housing containing said vibration actuator, and a vibration transmitting member coupling said fitting member to said housing.

13. A vibration apparatus as claimed in claim 12, wherein an elastic material is interposed between at least one of:

(i) said fitting member and said vibration transmitting member, and (ii) said vibration transmitting member and said housing.

14. A vibration apparatus as claimed in claim 13, wherein said elastic material comprises a double-side adhesive tape.

15. A vibration apparatus as claimed in claim 12, wherein said housing comprises at least one positioning member for positioning said vibration transmitting member.

16. A vibration apparatus as claimed in claim 12, wherein said vibration transmitting member comprises at least one positioning member for positioning said fitting member.

17. A vibration apparatus as claimed in claim 9, wherein said vibration apparatus is adapted to be vibrationally coupled to a human body of a user when said vibration apparatus is used by the user.

18. A vibration apparatus as claimed in claim 17, wherein vibration of said vibration actuator is adapted to cause a vibration of at least one of a bone, a tendon, a skin, and a subcutaneous tissue of a human body, so as to cause a sensible vibration in at least one of said first, said second, and said third vibration modes.

19. A mobile apparatus including a vibration apparatus as claimed in claim 9.

20. A vibration actuator as claimed in claim 1, wherein said particular vibration wave generates a speech sound.

21. A vibration actuator as claimed in claim 1, wherein said particular vibration wave generates an audible sound.

22. A vibration actuator as claimed in claim 1, wherein said particular vibration wave vibrates a bone of the human body.

23. A vibration actuator as claimed in claim 1, wherein said particular vibration wave vibrates a tendon of the human body.

24. A vibration actuator as claimed in claim 1, wherein said particular vibration wave vibrates human skin.

25. A vibration actuator as claimed in claim 1, wherein said particular vibration wave vibrates a subcutaneous tissue of the human body.

26. A method of driving a vibration actuator wherein said vibration actuator comprises a magnetic circuit device having a magnetic gap, a supporting device which elastically supports said magnetic circuit device, a coil inserted into said magnetic gap, and a vibration plate supporting said coil, and wherein said actuator has a first vibration mode in which said magnetic circuit device mainly vibrates to transmit body-felt vibration, a second vibration mode in which said coil mainly vibrates to produce a buzzer sound through said vibration plate, and a third vibration mode in which both said magnetic circuit device and said coil vibrate simultaneously so as to generate vibration of said vibration plate and produce a particular vibration wave represented by a combination of the vibrations of said magnetic circuit device and said vibration plate, said method comprising:

preparing a plurality of electric signals having different frequencies; and supplying one of said electric signals to said coil to achieve one of said first, said second, and said third vibration modes.

27. A method as claimed in claim 26, wherein each of said electric signals comprises one of a sine-wave signal and a rectangular-wave signal.

28. A method of driving a vibration actuator wherein said vibration actuator comprises a magnetic circuit device having a magnetic gap, a supporting device which elastically supports said magnetic circuit device, a coil inserted into said magnetic gap, and a vibration plate supporting said coil, and wherein said actuator has a first vibration mode in which said magnetic circuit device mainly vibrates to transmit body-felt vibration, a second vibration mode in which said coil mainly vibrates to produce a buzzer sound through said vibration plate, and a third vibration mode in which both said magnetic circuit device and said coil vibrate simultaneously so as to generate vibration of said vibration plate and produce a particular vibration wave represented by a combination of the vibrations of said magnetic circuit device and said vibration plate, said method comprising:

preparing a plurality of electric signals having different frequencies; and supplying a superposition of at least two of said electric signals to said coil to simultaneously achieve at least two of said first, said second, and said third vibration modes.

29. A method as claimed in claim 27, wherein each of said electric signals comprises one of a sine-wave signal and a rectangular-wave signal.

* * * * *